US007256803B2

(12) United States Patent
Hilbert

(10) Patent No.: US 7,256,803 B2
(45) Date of Patent: Aug. 14, 2007

(54) DIRECT THERMAL PRINTER

(75) Inventor: John Hilbert, Torrance, CA (US)

(73) Assignee: FutureLogic, Inc., Glendale, CA (US)

( * ) Notice: Subject to any disclaimer, the term of this patent is extended or adjusted under 35 U.S.C. 154(b) by 217 days.

(21) Appl. No.: 10/673,044

(22) Filed: Sep. 26, 2003

(65) Prior Publication Data

US 2004/0130610 A1 Jul. 8, 2004

Related U.S. Application Data

(60) Provisional application No. 60/414,003, filed on Sep. 26, 2002.

(51) Int. Cl.
*B41J 2/32* (2006.01)

(52) U.S. Cl. ..... 347/171

(58) Field of Classification Search ..... 347/171, 347/185–187, 203, 233–235, 236, 240, 241, 347/243, 246, 250, 237
See application file for complete search history.

(56) References Cited

U.S. PATENT DOCUMENTS 5,909,232 A * 6/1999 Goto et al. ..... 347/187
6,195,115 B1 * 2/2001 Yamaguchi ..... 347/238
6,281,921 B1 * 8/2001 Sugaya et al. ..... 347/203
6,325,474 B1 * 12/2001 Betzold et al. ..... 347/224
6,359,641 B1 * 3/2002 Nacman et al. ..... 347/235
6,677,971 B2 * 1/2004 Sasaki ..... 347/238
6,744,459 B2 * 6/2004 Hamada ..... 347/250
6,753,896 B2 * 6/2004 Shirota et al. ..... 347/236
6,791,594 B2 * 9/2004 Takeuchi ..... 347/241
6,798,439 B2 * 9/2004 Rudi ..... 347/240
6,900,825 B2 * 5/2005 Kito ..... 347/239
2002/0051055 A1 * 5/2002 Morizono et al. ..... 347/246

* cited by examiner

*Primary Examiner*—K. Feggins
(74) *Attorney, Agent, or Firm*—Fitzpatrick, Cella, Harper & Scinto

(57) ABSTRACT

A direct thermal printer device that can be used in any application using thermal printers. A direct thermal printer creates images on thermally active medium by applying light energy or radiant thermal energy created by a thermal heat source to create the heat necessary for generating an image on the thermal medium. The thermal energy source may be a laser, a high output light source, or a radiant heating element.

1 Claim, 4 Drawing Sheets

DIRECT THERMAL PRINTER

CROSS-REFERENCE TO RELATED APPLICATION

This application claims the benefit of U.S. Provisional Patent Application No. 60/414,003, filed Sep. 26, 2002, which is hereby incorporated by reference as if fully stated herein.

BACKGROUND OF THE INVENTION

This invention relates generally to printers and more specifically to high-speed thermal printers.

Traditionally, thermal printers contain a thermal print head that having one thermal element for each dot that can be imaged on the paper. For example, a typical traditional thermal print head, that has a printing granularity of 8 dots per millimeter, will have eight thermal elements per millimeter. A four-inch wide printer will have over eight hundred thermal elements to form a complete four-inch row of print.

Each thermal element can be individually controlled in such a manner to allow the thermal element to be on or off to form the dot pattern necessary in creating a dot of the image to be printed. The thermal elements have a resistive component and are heated by applying a voltage of sufficient amplitude and time duration to raise the temperature of the thermal element to a point that causes the thermally active paper to change color and form a dot. Typically, 0.3 millijoules of power are required to image a dot.

A limiting factor for the printing speed of this technology is the fact that the thermal elements retain heat. The heat is normally transferred to a heat sink that is part of the print head mechanism. The printer industry terms the capacity of a thermal print head to store heat the heat storage coefficient. Stated alternately, this is the rate at which the print head removes the heat generated by the thermal printing process. If the head temperature rises to a predefined temperature, the printing process must. slow down or stop to prevent damage to the thermal elements on the thermal print head.

Practical field experience with traditional thermal print heads that there are areas in need of improvement in the current thermal printer designs and implementation related to improved methods and means of printing images on a variety of thermally active media. Specifically, use thermal print heads having resistive elements and incorporating heat sinks

DEFINITIONS

For the purposes of this document, the following definitions apply:

"Thermal Printer(s)"—A printer where media with a heat sensitive side is imaged using a print head which applies heat in tiny dots (1/200th of an inch in size or smaller) in order to turn the area black. In this manner, all images are created by a series of tiny black dots. A widely known example of a thermal printer is the original fax machine.

"Thermal Medium"—A type of printable media with at least one heat sensitive side. The thermal medium receives an image using a thermal print head which applies heat in tiny dots (1/200th of an inch in size or smaller) in order to turn an area black.

"Write Once Media"—A definition referring to any printable media that can only be written on or imaged one time. Standard thermally active paper is an example.

SUMMARY OF THE INVENTION

A direct thermal printer device that can be used in any application using thermal printers. A direct thermal printer creates images on thermally active medium by applying light energy or radiant thermal energy created by a thermal heat source to create the heat necessary for generating an image on the thermal medium.

In one aspect of the current invention, the DTP contains a means to image the thermally active paper using a lasers as a heat source and a means to redirect the light source, such as a moveable reflective optical device, to reposition the laser's output in order to image each dot of the image to be produced on the paper. The laser may be of different wavelengths and utilize modulation techniques separately and/or in combination to achieve single and/or multiple color imaging on the thermally active paper.

In another aspect of the current invention, the DTP contains a means to image the thermally active paper using an array of lasers used individually or in combination to image the dots of the image to be produced on the paper. The lasers may be of different wavelengths and utilize modulation techniques separately and/or in combination to achieve single and/or multiple color imaging on the thermally active paper.

In another aspect of the current invention, the DTP contains a means to image the thermally active paper using Liquid Crystal Displays (LCD) containing at least one LCD or in an array of LCDs, each LCD acting as a shutter. The LCDs either open to allow the passage of energy thereby creating a dot image on the thermally active paper, or closed to block the passage of energy thereby not creating a dot image on the thermally active paper. The LCDs may be used individually or in combination to image the dot(s) of the image to be produced on the paper. The source of energy may be any thermal source such as a heater element or a light source.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
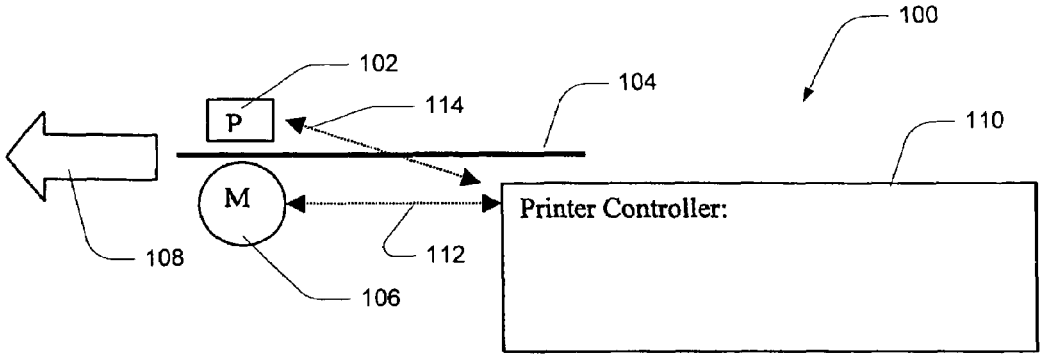
FIG. 1 is a block diagram of an exemplary thermal printer mechanism.

FIG. 1 is a block diagram of an exemplary thermal printer mechanism. A thermal printer 100 includes a thermal print head 102 used to head portions of a thermal medium 104. A motor driven thermal medium drive mechanism 106 moves the thermal medium through the thermal printer as indicated by medium movement direction arrow 108. The drive mechanism also holds the thermal medium in contact or close proximity to the thermal print head to ensure that the thermal energy generated by the print head is properly transferred to the thermal medium. The thermal print head and drive mechanism are operably coupled to a printer controller 110.

In operation, printer controller generates drive mechanism control signals 112 that are transmitted by the printer controller to the drive mechanism. In response to the drive mechanism control signals, the drive mechanism moves the paper under the thermal print head. The printer controller also generates thermal print head drive signals 114 that are transmitted by the printer controller to the thermal print head. The thermal print head drive signals are used by the thermal print head to energize thermal elements in the thermal print head. The thermal print head heats the individual thermal elements to form a dot row of the complete image. The drive mechanism then advances the thermal medium. This process is repeated until a complete image is transferred to the thermal medium.

Figure 2:
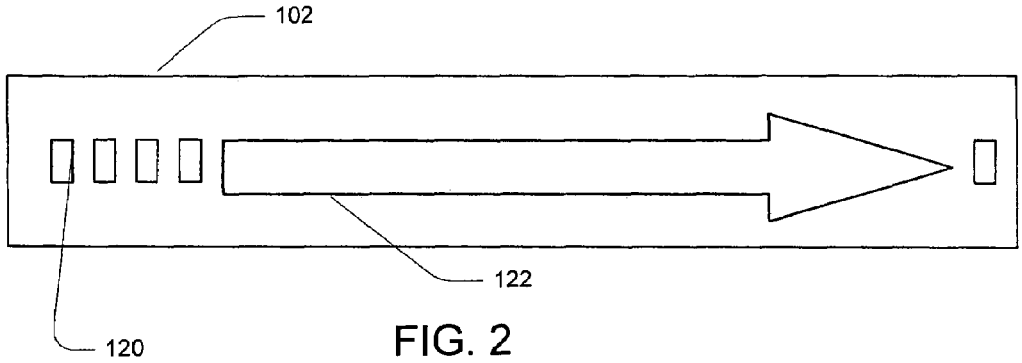
FIG. 2 is a block diagram of an exemplary thermal print head.

FIG. 2 is a block diagram of an exemplary thermal print head. The thermal print head 102 includes a row of individual elements 120 spaced apart along a length of the thermal print head. The width of the thermal print head is dependent upon the width of the thermal medium. The spaced apart thermal elements are distributed along the length of the thermal print head as indicated by arrow 122.

Figure 3:
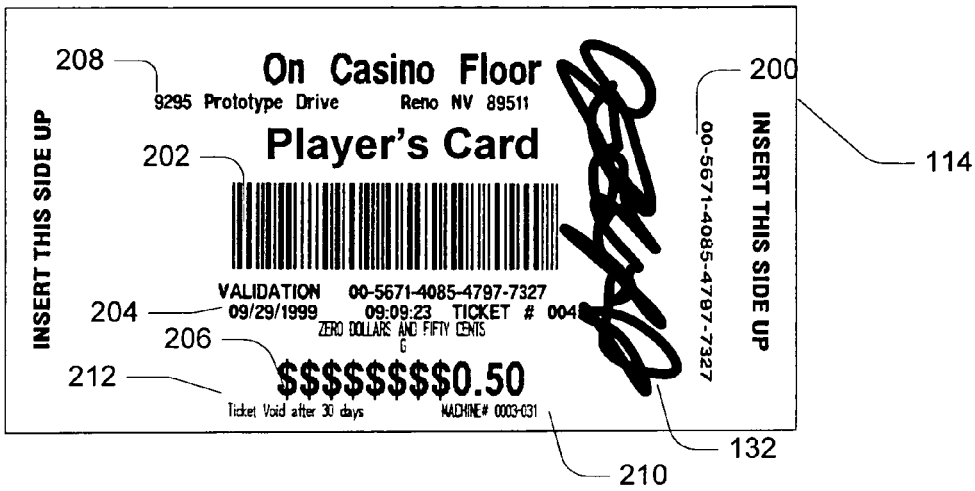
FIG. 3 is an illustration of a voucher in accordance with an exemplary embodiment of the present invention.

FIG. 3 is an illustration of a thermal printer output in the form of a voucher in accordance with an exemplary embodiment of the present invention. The image as shown on the voucher is created by imaging one dot at a time. The combination of these dots create the complete image. Dots are imaged by heating elements 120 of FIG. 2 that are capable of raising the temperature of the thermally active thermal media to a point where the thermal media changes color and a dot is formed. The voucher shown 124 is produced from commands issued by a gaming machine to a gaming printer in response to a player's request to cash-out. The voucher includes features such as a validation number, printed in both a human readable form such as a character string 200 and in a machine-readable form such as a bar code 202, time and date stamps 204, cash-out amount 206, casino location information 208, cashless enabled game identifier 210, and an indication of an expiration date 212. Included in the voucher is a security feature 132 that may take one or more forms.

In one thermal medium in accordance with an exemplary embodiment of the present invention, one face of the voucher includes a layer of writable and erasable thermally sensitive film. The thermal film becomes opaque at one temperature level but becomes transparent at another temperature. This effect can be used to create a thermally rewritable voucher.

Figure 4:
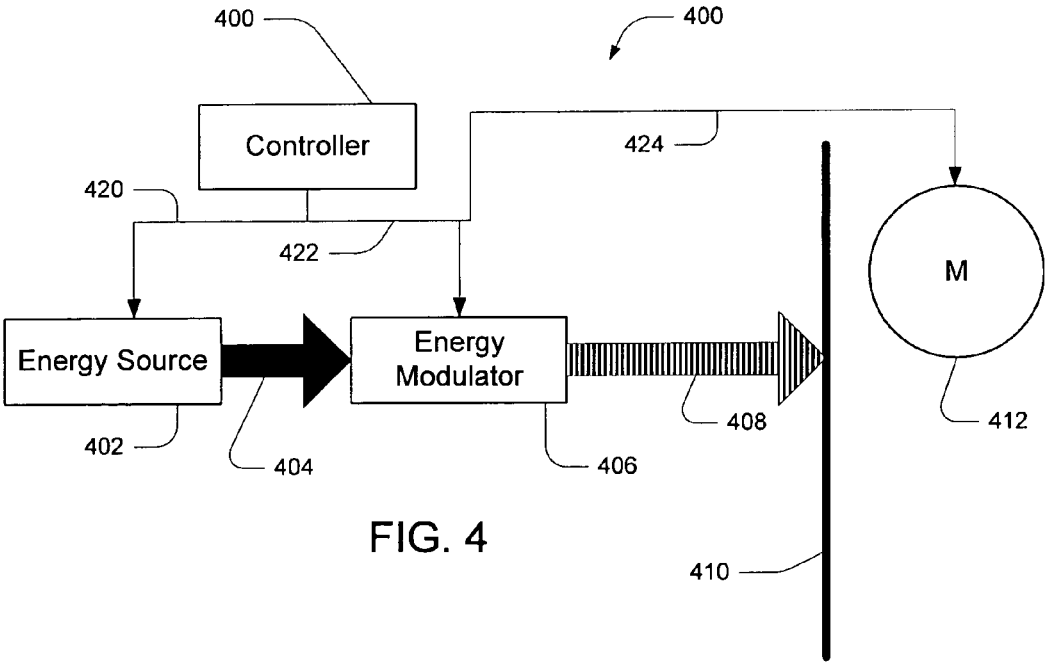
FIG. 4 is a block diagram of a direct thermal printer in accordance with an exemplary embodiment of the present invention.

FIG. 4 is a block diagram of a direct thermal printer in accordance with an exemplary embodiment of the present invention. A direct thermal printer includes a thermal energy source 402 that generates thermal energy 404 in sufficient quantity to create an image on a thermal medium 410. Interposed between the thermal energy source and the thermal medium is a thermal energy modulator 406 that receives the thermal energy and generates modulated thermal energy 408. The modulated thermal energy impinges directly onto the thermal medium. In response to the modulated thermal energy, portions of the thermal medium directly affected by the modulated thermal energy change color. In the case where the thermal medium is rewritable, the thermal medium may be written to using modulated thermal energy at a first power level and erased using modulated thermal energy at a second power level. A thermal medium drive mechanism 412 moves the thermal medium through the direct thermal printer. As the thermal energy is transmitted as radiant energy to the thermal medium, the thermal energy modulator need not be in contact with the thermal medium as may be required by the thermal printer 100 of FIG. 1.

The thermal energy source, thermal energy modulator, and the thermal medium drive mechanism are coupled to a printer controller 400. The printer controller generates thermal energy source control signals 420 that are transmitted to the thermal energy source. In response to the control signals, the thermal energy source generates thermal energy 404 of at power levels sufficient to make an image on the thermal medium. The printer controller also generates thermal energy modulation signals 422 that are transmitted to the thermal energy modulator. In response to the thermal energy modulation signals, the thermal energy modulator adjusts the power level of the thermal energy or changes the location where the thermal energy impinges upon the thermal medium, thus creating modulated thermal energy 408. The printer controller also generates thermal medium drive mechanism control signals 424 that are transmitted to the drive mechanism in order to control the operations of the drive mechanism. In response to the control signals, the drive mechanism moves the thermal medium through the direct thermal printer.

Figure 5:
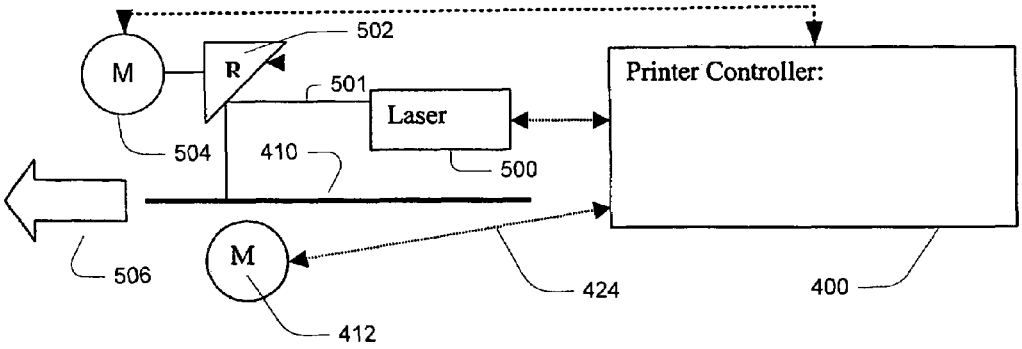
FIG. 5 is a block diagram of a direct thermal printer employing a laser-based thermal energy source in accordance with an exemplary embodiment of the present invention.

FIG. 5 is a block diagram of a direct thermal printer employing a laser-based thermal energy source in accordance with an exemplary embodiment of the present invention. The thermal energy used by a direct thermal printer may come from a variety of sources. In one direct thermal printer in accordance with an exemplary embodiment of the present invention, the thermal energy source is a laser 500. The laser is used to image each dot on the paper. The output 501 of the laser is directed by a moveable reflector 502 coupled to a motorized optical stage 504. The movable reflector provides the means to image a dot row on a thermal medium 410. Thus the movable reflector acts as a thermal energy modulator receiving thermal energy from the thermal energy source and transmitting modulated thermal energy to the thermal print medium. After each dot row is complete, the thermal medium drive mechanism 412 causes the thermal medium to advance 506 so that a next dot row can be imaged. This process continues until an image is completed on the thermal medium.

The process is controlled by a printer controller 400 coupled to the laser, the motorized optical stage, and the drive mechanism. In operation, the controller generates laser control signals 507 that are transmitted to the laser. In response to the laser control signals, the laser generates an output 501. In the case of a laser, the power output of the laser may be modulated by rapidly turning the laser on and off by the controller. The controller also generates optical stage control signals 508 that are transmitted to the motorized optical stage. In response to the optical stage control signals, the motorized optical stage directs the output of the laser to impinge on the thermal medium. By synchronizing the operations of the motorized optical stage and the power output of the laser, the printer controller causes an image to be formed on the thermal medium. To advance the thermal medium through the direct thermal printer, the controller generates thermal medium drive mechanism control signals 424 that are transmitted to the drive mechanism.

Figure 6:
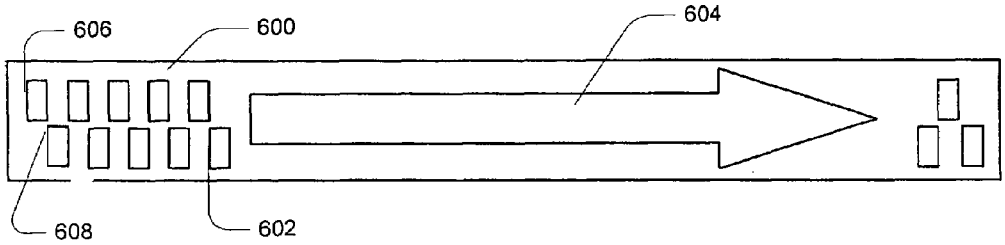
FIG. 6 is a block diagram of a direct thermal print head employing discreet laser devices as thermal energy sources in accordance with an exemplary embodiment of the present invention.

FIG. 6 is a block diagram of a direct thermal print head employing discreet laser devices as thermal energy sources in accordance with an exemplary embodiment of the present invention. In this embodiment, a direct thermal print head 600 employs an array of spaced apart laser elements 602 to generate thermal energy used to create images on the thermal medium 410 (of FIG. 5). The array spans the width of the direct thermal print head as indicated by arrow 604. The array of lasers can be used to image a part of or a complete dot row on the thermal medium as each laser is capable of imaging one dot on the thermal medium. The array of lasers can be arranged in multiple rows 606 and 608, to allow for greater printing granularity. The direct thermal print head having an array of lasers can be used in the same manner as the thermal print head 102 of FIG. 2 in the thermal printer 100 of FIG. 1.

Figure 7:
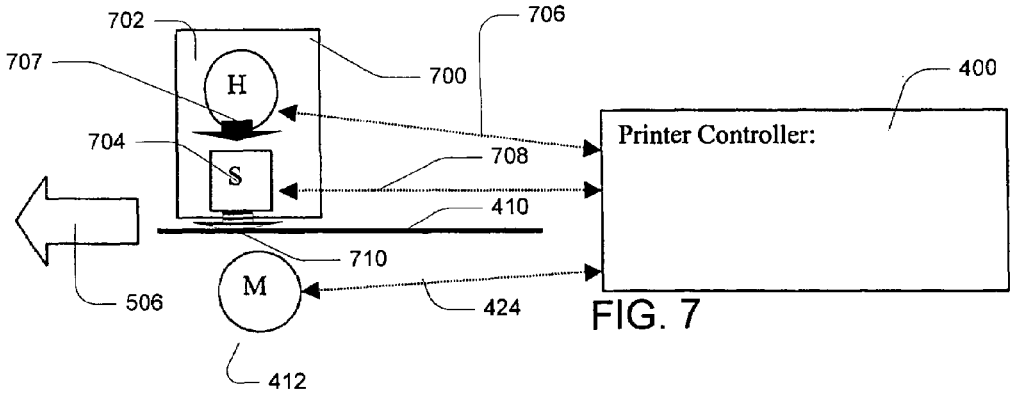
FIG. 7 is a block diagram of a direct thermal printer using a light-based or heater-based thermal energy source in accordance with an exemplary embodiment of the present invention.

FIG. 7 is a block diagram of a direct thermal printer using a light-based or heater-based thermal energy source in accordance with an exemplary embodiment of the present invention. In this embodiment, a direct thermal print head 700 includes a radiant thermal energy source 702, such as a high output light or heater element, and an array of LCD's 704 acting as shutters to selectively allow thermal energy to pass through to the thermal medium 410. Using a single thermal energy source, the LCD shutters are opened to image a dot on the thermal medium and closed to avoid imaging a dot on the thermal medium. Thus the LCD shutter device acts as a thermal energy modulator receiving thermal energy from the thermal energy source and transmitting modulated thermal energy to the thermal print medium. After each dot row is complete, a thermal medium drive mechanism 412 causes the thermal medium to advance 506 in the direction shown.

The process is controlled by a printer controller 400 coupled to the thermal energy source, the LCD shutters, and the drive mechanism. In operation, the controller generates thermal energy source control signals 706 that are transmitted to the thermal energy source. In response to the control signals, the thermal energy source generates thermal energy 707 of sufficient power to create an image on the thermal medium. In the case of a heater element or light source, the power output of the thermal energy source may be modulated by adjusting the amount of electrical power used to drive the thermal energy source. The thermal energy is then directed to one side of the LCD shutters. The controller also generates LCD shutter control signals 708 that are transmitted to the LCD shutters. In response to the control signals, the LCD shutters selective transmit the thermal energy in the form of a modulated thermal energy 710 that impinges on the thermal medium. By synchronizing the operations of the LCD shutters and the power output of the thermal energy source, the printer controller causes an image to be formed on the thermal medium. To advance the thermal medium through the direct thermal printer, the controller generates thermal medium drive mechanism control signals 424 that are transmitted to the drive mechanism.

Figure 8:
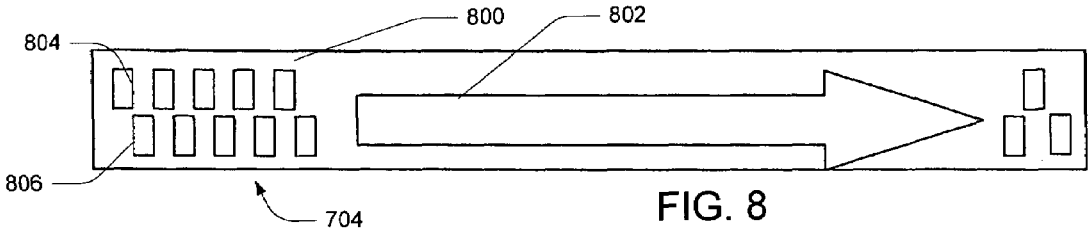
FIG. 8 is a block diagram of a LCD shutter used in conjunction with a direct thermal printer using a light-based or heater-based thermal energy source in accordance with an exemplary embodiment of the present invention.

FIG. 8 is a block diagram of a LCD shutter device used in conjunction with a direct thermal printer using a light-based or heater-based thermal energy source in accordance with an exemplary embodiment of the present invention. In the shutter device 704 an array of LCD shutters 800 are distributed along a length of the LCD shutter device as indicated by arrow 802. The LCDs may be arranged in multiple rows 804 and 806 to allow for greater printing granularity. In operation, each LCD shutter may be individually controlled be a printer controller 400 (of FIG. 7) to allow transmission or block transmission of thermal energy 707 (of FIG. 7) from a thermal energy source 702 (of FIG. 7) to a thermal medium 410 (of FIG. 7).

Figure 9:
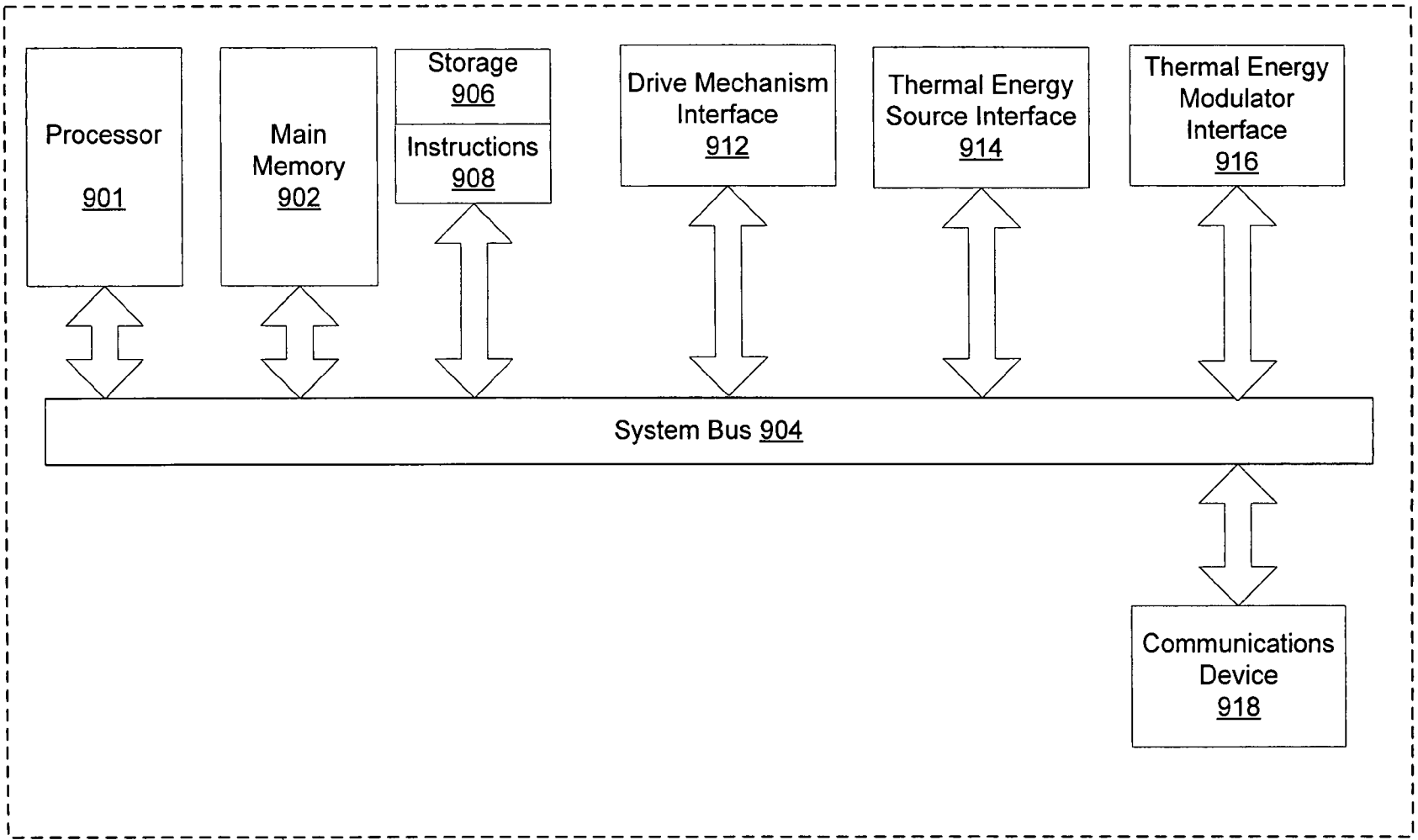
FIG. 9 is a block diagram of a printer controller in accordance with an exemplary embodiment of the present invention.

FIG. 9 is a block diagram of a direct thermal printer controller in accordance with an exemplary embodiment of the present invention. A direct thermal printer controller 400 includes a processor 901 coupled to a main memory 902 via a system bus 904. The processor is also coupled to a data storage device 906 via the system bus. The storage device includes programming instructions 908 implementing the features of a direct thermal printer as described above. In operation, the processor loads the programming instructions into the main memory and executes the programming instructions to implement the features of direct thermal printer as previously described.

The controller may further include one or more communications device interfaces 918 coupled to the processor via the system bus. The direct thermal printer controller uses a communications device interface to communicate with other devices as previously described.

The controller may further include a thermal medium drive mechanism interface 912 coupled to the processor via the system bus. The controller uses the thermal medium drive mechanism interface to generate control signals for a thermal medium drive mechanism as previously described.

The controller may further include a thermal energy source interface 914 coupled to the processor via the system bus. The controller uses the thermal energy source interface to generate control signals for a thermal energy source, such as a laser, heating element, or high output light source, as previously described.

The controller may further include a thermal energy modulator interface 916 coupled to the processor via the system bus. The controller uses the thermal energy modulator interface to generate control signals for a thermal energy modulator, such as a movable reflector or LCD shutter array, as previously described.

Although this invention has been described in certain specific embodiments, many additional modifications and variations would be apparent to those skilled in the art. It is therefore to be understood that this invention may be practiced otherwise than as specifically described. Thus, the present embodiments of the invention should be considered in all respects as illustrative and not restrictive, the scope of the invention to be determined by any claims supported by this application and the claims' equivalents rather than the foregoing description.

What is claimed is:

1. A direct thermal printer, comprising:

a direct thermal print head comprising an array of thermal energy sources directly radiantly coupled to a thermal print medium;

a thermal print medium drive mechanism holding the thermal print medium in noncontacting proximity to the direct thermal print head without a thermal energy modulator interposed between the thermal print medium and the direct thermal print head; and a controller coupled to the direct thermal print head and the thermal print medium drive mechanism, wherein the output power of the thermal energy sources are individually controllable by the controller, wherein the thermal energy sources are heater elements.

* * * * *

UNITED STATES PATENT AND TRADEMARK OFFICE

CERTIFICATE OF CORRECTION

PATENT NO. : 7,256,803 B2
APPLICATION NO. : 10/673044
DATED : August 14, 2007
INVENTOR(S) : Hilbert It is certified that error appears in the above-identified patent and that said Letters Patent is hereby corrected as shown below:

COLUMN 1:
Line 16, “having” should read -- has --;
Line 29, “0.3 mill-” should read -- 0.3 milli- --;
Line 39, “must.” should read -- must --;
Line 46, “use” should read -- using --; and
Line 47, “sinks” should read -- sinks. --.

COLUMN 2:
Line 10, “lasers” should read -- laser --; and
Line 59, “discreet” should read -- discrete --.

COLUMN 3:
Line 10, “to head” should read -- to heat --.

COLUMN 5:
Line 6, “discreet” should read -- discrete --.

COLUMN 6:
Line 3, “be” should read -- by --.

Signed and Sealed this

Twentieth Day of May, 2008

JON W. DUDAS
*Director of the United States Patent and Trademark Office*